United States Patent [19]

Eilersen

[11] Patent Number: 5,023,966

[45] Date of Patent: Jun. 18, 1991

[54] PIECE OF FURNITURE

[76] Inventor: Jens J. Eilersen, "Villa Malou" - Domaine de la Veroninere, Valbonne, France, 06560

[21] Appl. No.: 560,169

[22] Filed: Jul. 31, 1990

[30] Foreign Application Priority Data

Aug. 10, 1989 [DK] Denmark ..... 3935/89

[51] Int. Cl.[5] ..... A47C 17/13; A47C 20/00

[52] U.S. Cl. ..... 5/17; 5/53.1; 5/59.1

[58] Field of Search ..... 5/2.1, 17, 18.1, 59.1, 5/53.1

[56] References Cited

U.S. PATENT DOCUMENTS

| | | | |
|---|---|---|---|
| 2,579,921 | 12/1951 | Gibbs | 5/59.1 |
| 2,694,207 | 11/1954 | MacEachron | 5/2.1 X |
| 2,709,817 | 6/1955 | Poyer | 5/59.1 |
| 2,904,796 | 9/1959 | Frey | 5/2.1 |
| 3,047,885 | 8/1962 | Bolinger | 5/17 X |
| 3,113,324 | 12/1963 | Kamp et al. | 5/17 X |
| 3,222,691 | 12/1965 | Osborne | 5/59.1 |

*Primary Examiner*—Michael F. Trettel
*Attorney, Agent, or Firm*—Darby & Darby

[57] ABSTRACT

A sitting or resting article of furniture comprising a stationary back rest portion (2) with a part (4) which rests on the floor, and a freely movable sitting or resting portion (1) which rests fully or partly on the back rest portion, and further comprising for example at least one stationary supporting leg (6) which rests directly on the floor, and at least one oblong list (3) which extends in the full width of the sitting or resting portion and rests directly on that part (4) of the back rest portion, which is placed below the sitting or resting portion (1).

14 Claims, 3 Drawing Sheets

PIECE OF FURNITURE

BACKGROUND OF THE INVENTION

The invention relates to a piece of furniture comprising a stationary back rest portion which rests on the floor, and a movable sitting or resting portion.

Many designs and structures are known for such furniture, like for instance so-called bed sofas, where the portions are arranged in such a manner that the piece of furniture is convertible between two applications; for sitting on and for sleeping in. These types of furniture are generally provided with a means of connection between the two portions, i.e. between the frame and the sitting or sleeping portion, for instance by guiding the sitting or sleeping portion in rails, grooves or the like in the frame. Alternatively the portions could be coupled together by means of fittings allowing the sitting or sleeping portion to be pulled out or unfolded to provide a sleeping surface, often to be supported by extra extendible supporting legs or the like.

SUMMARY OF THE INVENTION

The object of the present invention is to provide a completely new furniture structure which comprises two independent portions; a back rest portion and a sitting or resting portion and arranged in such a manner that the sitting or resting portion may be positioned absolutely freely relative to the back rest portion. The new piece of furniture is not primarily meant as a replacement for the known bed sofa structures. It is a sitting or resting article of furniture which may be adjusted to various applications, like for example for sitting or lying in when watching television, or it could be applied as an ordinary room article of furniture when serving, reading the paper or the like or for simply resting.

The above object is achieved by designing the piece of furniture according to the invention as presented. The sitting or resting portion rests on a part of the back rest portion so that the weight of the sitting or resting portion together with the weight of the person or persons who sit(s) in the piece of furniture squeeze or press the back rest portion against the floor, thus preventing it from slipping, even if one or more persons lean heavily against the back rest portion or sit down heavily or suddenly.

The sitting or resting portion is thus movable in any direction within wide limits relative to the back rest portion and accordingly the piece of furniture as a whole has a very wide field of application in addition to a variable appearance, depending on how the two portions are positioned in relation to each other.

If the piece of furniture according to the invention is designed as presented, a stable piece of furniture is achieved, where the sitting or resting portion in particular is stable within a large area which is limited by the configuration and size of the back rest portion.

By designing the piece of furniture according to the invention, a simple and thus production-wise advantageous structure is achieved. It is, moreover, possible to combine different back rest portions with different sitting or resting portions so that by combining different portions in one piece of furniture, any desire in respect of design or application may be met.

By designing the piece of furniture according to the invention, the adjustment of the sitting or resting portion in relation to the back rest portion is facilitated. In practice it has been found that the friction between the portions may be reduced, since after all the sitting or resting portion does not move in relation to the back rest portion, if, for example, a person sits down or gets up, because the stationary supporting leg(s) which rest on the floor prevent this.

By designing the piece of furniture according to the invention, it is rendered possible to produce many different designs of the piece of furniture for a number of different applications by applying the above technique.

BRIEF DESCRIPTION OF THE DRAWING

The invention will hereafter be explained in further detail with reference to the drawing, in that FIG. 1 is a top front perspective view of the piece of furniture according to a first embodiment of the invention.

DESCRIPTION OF THE PREFERRED EMBODIMENTS

Figure 1:
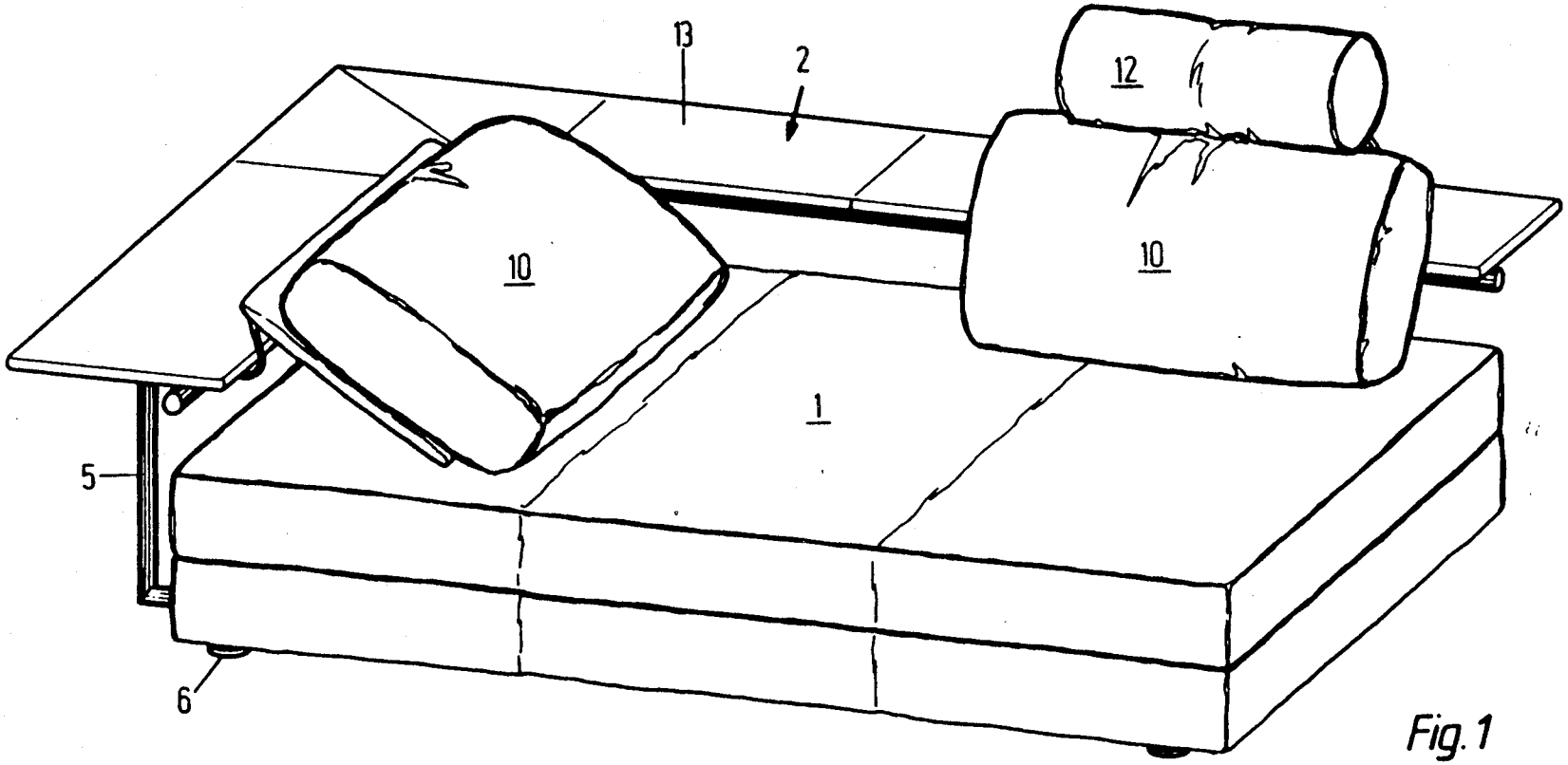
Figure 2:
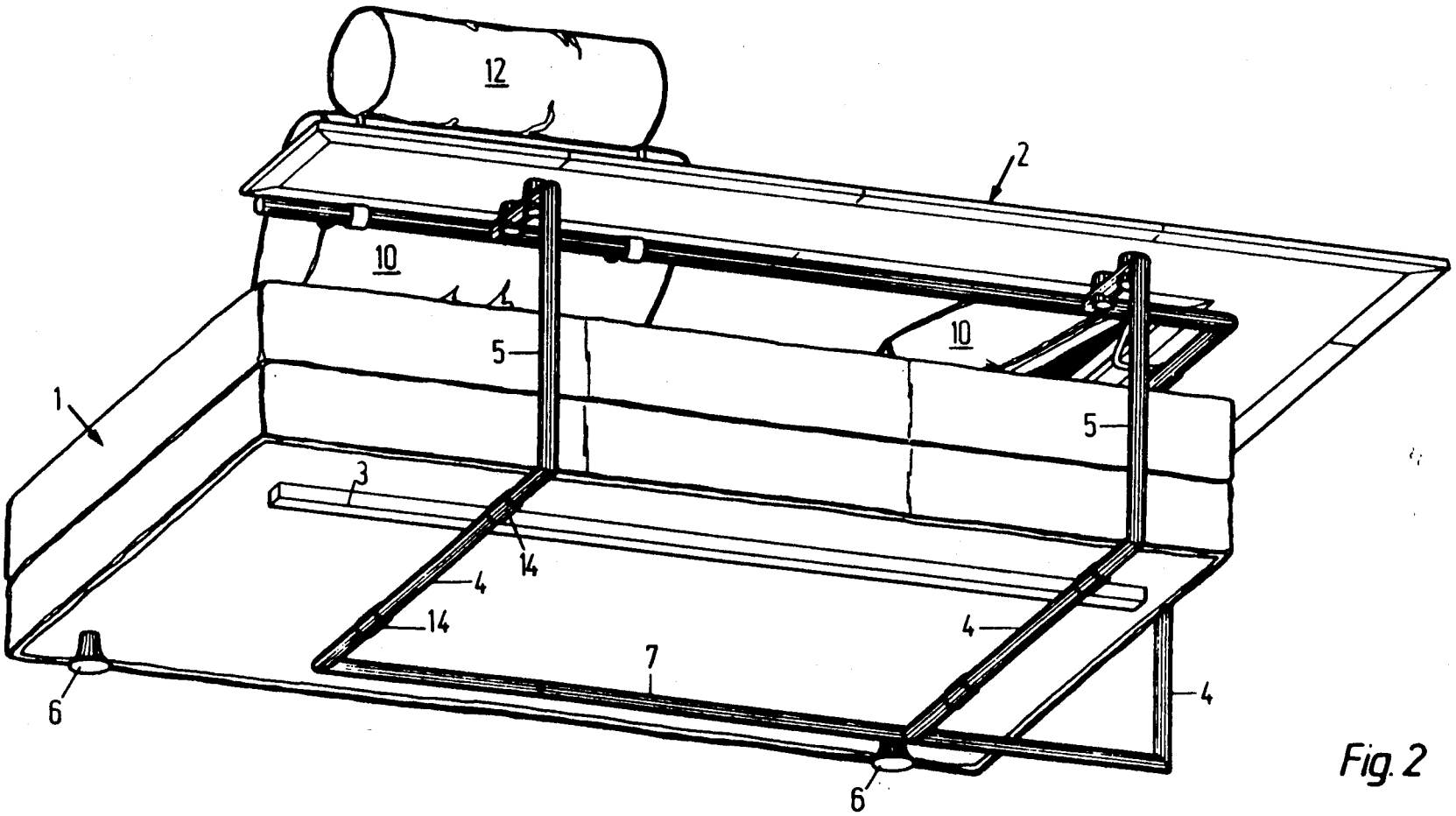
FIG. 2 is a rear view of the piece of furniture in FIG. 1 at an inclined angle from below.

FIGS. 1 and 2 both show a first embodiment of the invention, in that FIG. 1 shows a sitting or resting portion and FIG. 2 shows the back rest portion as a whole.

The sitting or resting portion 1 could be designed as a rectangular box as shown, but could naturally have any other design. At the under side of the sitting or resting portion 1 two supporting legs 6 are provided which are arranged to rest on the floor, and also provided is a longitudinally extending rubbing list 3 or strip which may be produced of or coated with Nylon (R), Teflon, or the like. The rubbing list 3 rests against a floor frame 4 which together with the tube parts 5, 7 make up a tube frame to support the shown table top arrangement 13 which is a part of the back rest portion in the embodiment as shown. Cushions 10 or cylindrical cushions 12 may be arranged in connection with the tube frame or the table top arrangement, which cushions may either lie loose against the table top arrangement or the tube frame or be fixed in a conventional manner. The floor frame 4 which is arranged to rest on the floor may be provided with various friction facings 14 making up the part which rests directly on the floor, partly in order to increase the friction against the floor, and partly to prevent the floor from being scratched. The floor frame 4 may be produced of any kind of rigid material, e.g. steel tubes, solid steel bars, or it may be a solid iron or steel plate.

The free movability of the sitting or resting portion 1 is obtained by means of the strip or list 3 which extends in the full length of the sitting or resting portion and allows this to be moved sideways in its full length and likewise forwards or backwards in its full length. The sitting or resting portion may thus be placed in any position within an area which is limited by the tube parts 4, 7.

Figure 3:
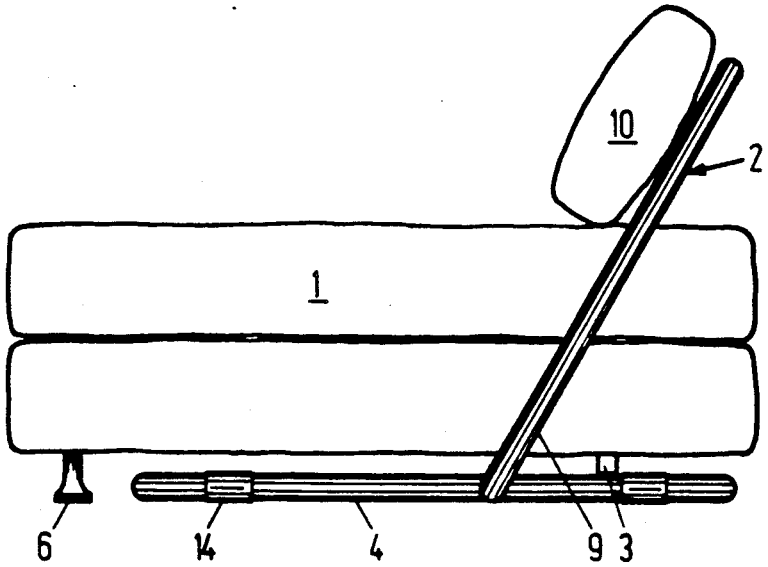
FIG. 3 is a side view of a piece of furniture according to a second embodiment of the invention.

FIG. 3 shows a second embodiment, where the back rest portion 2 is designed differently in that the part 9 which makes up the back rest proper and supports the cushion 10, is secured on the floor frame 4 and extends upwards along the end portions of the sitting or resting portion 1. In this configuration the back rest or the back plate 9 makes up a portal-like portion which extends along the sitting or resting portion.

Figure 4:
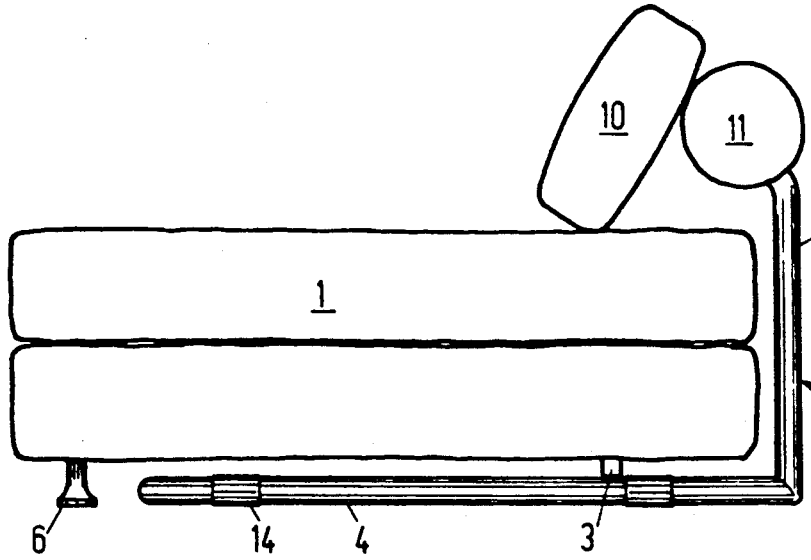
FIG. 4 is another side view of the piece of furniture according to the invention in a third embodiment.

FIG. 4 shows a third embodiment, where a cylindrical back cushion is applied to support the cushion 10, instead of the table top arrangement as shown in FIGS. 1 and 2. The cylindrical back cushion is secured to a back rest 8.

The configurations as shown in FIGS. 3 and 4 are both seen in the direction towards the end portion of the piece of furniture.

Even if the back rest portion 2 is designed as a tube structure, according to the embodiments presented and the explanation, it may also be designed differently without deviating from the principles of the invention. The portion 4 which is placed below the sitting or resting portion could for example be a wooden, an iron or a metal plate, and the parts which extend upwards from the portion 4 and support or hold the cushion arrangements or the table top arrangement could be designed as wooden or metal plates or plate parts.

I claim:

1. A piece of furniture, comprising:

a stationary back rest part having at least a substantially horizontal portion for resting on a floor;

a movable part for sitting or resting thereon, said movable part being subject to resting at least partially on said substantially horizontal portion, said movable part including support means for contacting with said substantially horizontal portion, said support means permitting relative motion between said back rest part and said movable part in any direction substantially parallel with said substantially horizontal portion.

2. A piece of furniture according to claim 1, wherein the sitting or resting part has at least one supporting leg for resting directly on the floor, said at least one leg and said support means jointly supporting said movable part.

3. A piece of furniture according to claim 2, wherein said support means is a strip which substantially extends the full width of the sitting or resting part.

4. A piece of furniture according to claim 3, said strip is one of made of and coated with a wear resisting and friction reducing material.

5. A piece of furniture according to claim 3, wherein said strip is oblong.

6. A piece of furniture according to claim 2, wherein the horizontal portion of the back rest part is produced of one of tubular metal including steel tubes and solid metal including steel.

7. A piece of furniture according to claim 2, wherein said horizontal portion of the back rest part, which is below the sitting or resting part, is one of a framework and a plate.

8. A piece of furniture according to claim 2, wherein the back rest portion is substantially a coherent structure arranged to fixedly hold other parts, such parts including a table top, and back support arrangements.

9. A piece of furniture according to claim 1, wherein the horizontal portion of the back rest part, is produced of one of metal or steel tubes and solid metal or steel.

10. A piece of furniture according to claim 9, wherein the back rest portion is substantially a coherent structure arranged to fixedly hold other parts, such parts including a table top, and back support arrangements.

11. A piece of furniture according to claim 1, wherein said horizontal portion of the back rest part, which is below the sitting or resting part, is one of a framework and a plate.

12. A piece of furniture according to claim 11, wherein the back rest portion is substantially a coherent structure arranged to fixedly hold other parts, such parts including a table top, and back support arrangements.

13. A piece of furniture according to claim 1, wherein the back rest portion is substantially a coherent structure arranged to fixedly hold other parts, such parts including a table top, and back support arrangements.

14. A piece of furniture according to claim 1, wherein said relative motion is a sliding motion.

* * * * *